United States Patent [19]

Rigon

[11] Patent Number: 4,654,915

[45] Date of Patent: Apr. 7, 1987

[54] PROCESS FOR THE PRODUCTION OF A FLEXIBLE ANATOMICAL INSOLE IN WOOD FOR SHOES AND FLEXIBLE INSOLE OBTAINED BY SAID PROCESS

[76] Inventor: Pietro L. Rigon, Via San Lazzaro, 7 Vicenza, Italy

[21] Appl. No.: 753,683

[22] Filed: Jul. 10, 1985

[30] Foreign Application Priority Data

Aug. 1, 1984 [IT] Italy ..... 85618 A/84

[51] Int. Cl.[4] ..... A43B 13/08; A43B 13/38

[52] U.S. Cl. ..... 12/146 B; 12/146 BR; 36/33; 36/43

[58] Field of Search ..... 12/146 B, 146 BP, 146 BR, 12/146 BC, 30 A, 31, 33, 43, 44

[56] References Cited

U.S. PATENT DOCUMENTS

| | | | |
|---|---|---|---|
| 1,198,720 | 9/1916 | Graydon | 12/146 B |
| 1,817,287 | 8/1931 | Bell | 12/146 BR |
| 1,853,990 | 4/1932 | Oakley | 36/31 |
| 1,935,519 | 11/1933 | Quinn | 12/146 BR |
| 1,959,382 | 5/1934 | Newton | 12/146 BR |
| 2,352,532 | 6/1944 | Ghez et al. | 36/33 |
| 2,381,937 | 8/1945 | Supple | 36/33 |
| 4,400,894 | 8/1983 | Ehrlich | 36/31 |
| 4,543,222 | 9/1985 | Ehrlich | 12/146 B |

FOREIGN PATENT DOCUMENTS

| | | | |
|---|---|---|---|
| 849255 | 11/1939 | France | 36/31 |

*Primary Examiner*—Werner H. Schroeder
*Assistant Examiner*—Steven N. Meyers
*Attorney, Agent, or Firm*—Bucknam and Archer

[57] ABSTRACT

According to the process of the invention one starts with a block of wood of approximately parallelepipedal shape from which, by means of operations of milling and turning, there are obtained opposed surfaces on which there are subsequently milled parallel channels extending through almost one-half of the thickness of the block. Into the channels there is introduced resilient rubber so as then to obtain a pair of perfectly symmetrical insoles, by making a longitudinal cut along the plane corresponding to one-half the thickness of the block. The insoles being made perfectly resilient by transverse layers of rubber which furthermore have anti-slip properties.

1 Claim, 6 Drawing Figures

PROCESS FOR THE PRODUCTION OF A FLEXIBLE ANATOMICAL INSOLE IN WOOD FOR SHOES AND FLEXIBLE INSOLE OBTAINED BY SAID PROCESS

The present invention has for its object to provide a process for the production of wooden insoles, of anatomical shape, of great flexibility, particularly adapted to be inserted in the built-up body of a wooden shoe, intended to be used also in a humid atmosphere or actually in water.

It is known that there is always obtained many sandals or similar types of shoes are known in which, into a body built-up of synthetic material, there are applied insoles of flexible or semi-rigid wood, such that the feet rest on a natural material, such as wood, so as to absorb and/or favour perspiration, without excluding the possbility of immersion in water and assuring at the same time a sufficient degree of flexibility, capable of not obstructing the articulation of the feet.

The flexible or semi-rigid wooden insoles hitherto produced have been made by glueing onto a flexible base of synthetic material very thin foils of wood, in the case of the semi-rigid insole, or of more massive or compensated wooden foils, and subsequently transverse recesses have been made so as to permit flexibility.

In practice, the flexible insole gives support, whilst the upper part of wood is made flexible as a result of its small thickness, made of foils, or by means of the transverse recesses when made of greater thickness.

It is easy to see that the semi-rigid insole does not give ample guarantee of wear and of flexibility, whilst the flexible one, mounted on a support, adds, to the disadvantage of the constructional complexity, the discomfort created by the recesses which can pinch the skin of the feet, or the stocking worn on the feet, during the phase of articulation. Such insoles furthermore cannot assume the different shapes of the flat insole.

The object of the present invention is to provide a process by means of which it is possible to obtain wooden insoles, both anatomical and non-anatomical, which are flexible and with advantages of a reduced production cost coupled with the fact that the product is superior, thanks to the absence of recesses on the surface of contact with the feet and to an almost total flexibility, to which there is added the advantage that the foot does not slide on the insole, both when damped with perspiration or bathing in the water, because the adhesive material inserted in the channels of the insole, apart from performing the function of keeping the various constituent parts of the same united, also permits the wood to increase or diminish in volume, with the variation of humidity, without changing the measure in length of the insole, and furthermore acting as a brake if the foot tends to slip.

The process will now be described in more detailed manner with the aid of the accompanying set of drawings, in which.

Figure 1:
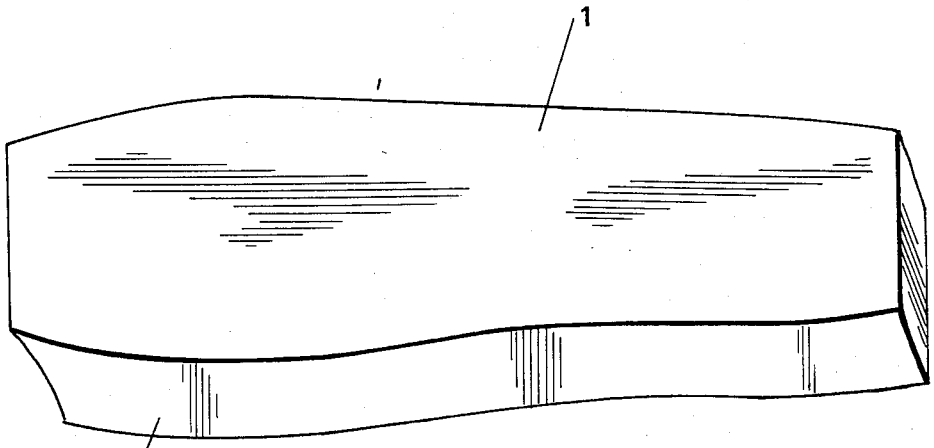
FIGS. 1, 2 and 3 show the first three successive phases of working of the insole.

As will be seen from FIG. 1, the working is commenced with the formation of a block of wood 1, of suitable dimensions and of the required characteristics, in which the lateral surfaces 2 are already shaped in a manner adapted to permit a good shaping of the insole.

Figure 2:
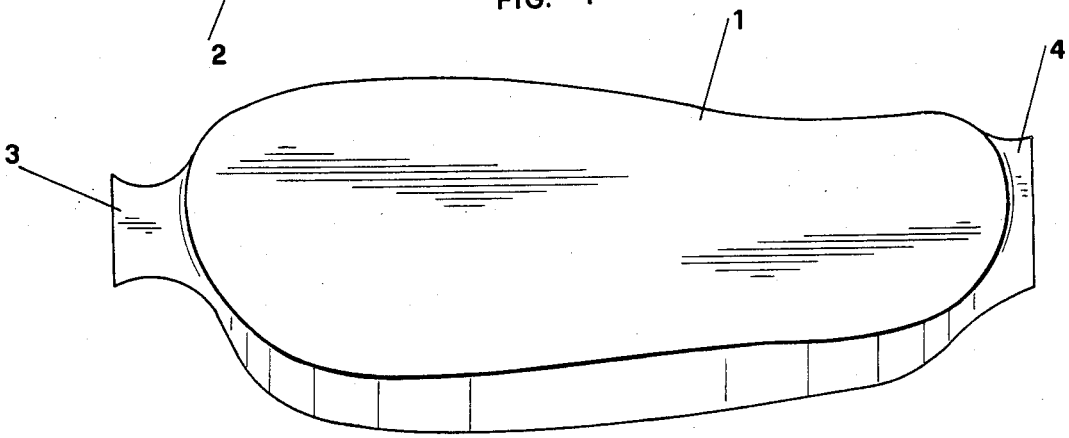

In FIG. 2 it will be noted that the block 1 is milled laterally in such a manner as to give rise to the approximate shape of the perimeter and of the surfaces of the insole, with two end protruberances 3 and 4 which are placed so as to permit the gripping of the block by the special turning-shaping machine which is used for the operation.

Figure 3:
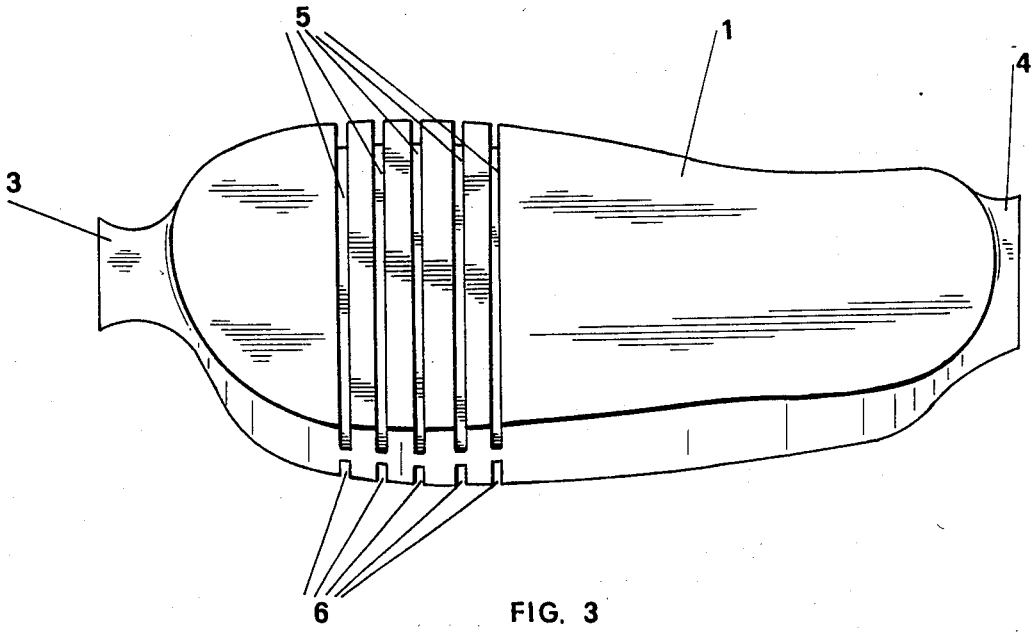

In FIG. 3 it will be noted that both of the opposite surfaces of the block 1 are provided with cuts, respectively 5 and 6, parallel to each other, which reach almost the centre of the thickness of the block 1, starting from each of the opposite faces, but leaving a sufficient thickness for the stability of the block 1.

Figure 4:
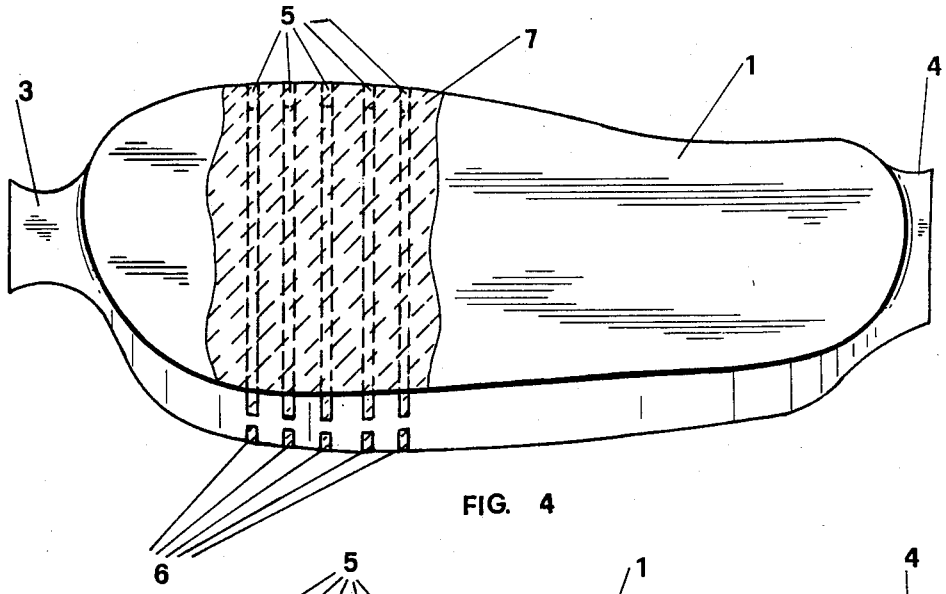
FIGS. 4, 5 and 6 show the last three successive phases of working of the insole, all seen in perspective view.
Figure 5:
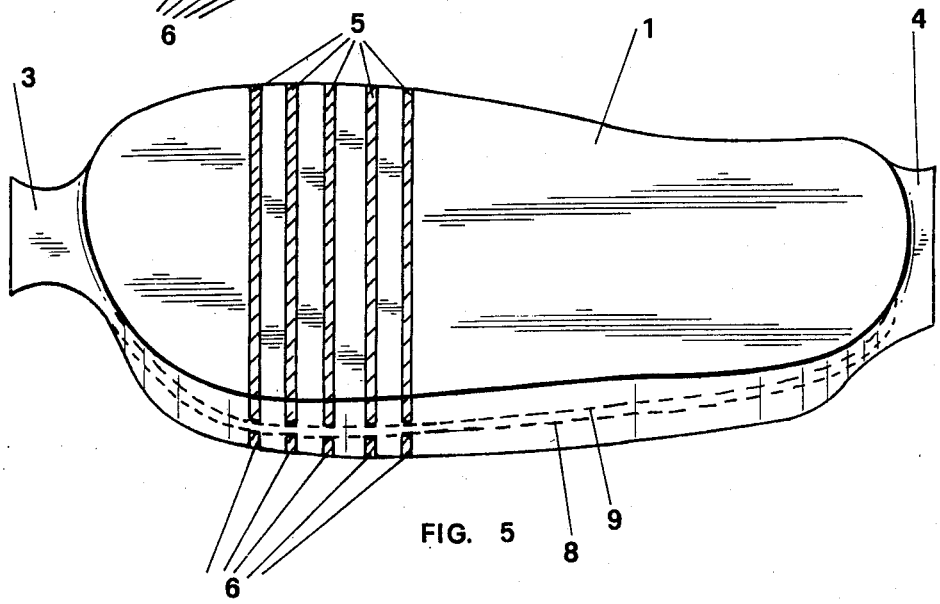

In FIG. 4 it will be noted that a layer of rubber 7 has been made to enter, in the cold, into the channels 5 and 6, whilst with a subsequent operation of milling, (FIG. 5) by means of a special so-called "turning" machine, there is removed rubber and wood including the remaining superficial layer of rubber, to leave only the rubber in the channels 5 and 6.

Figure 6:
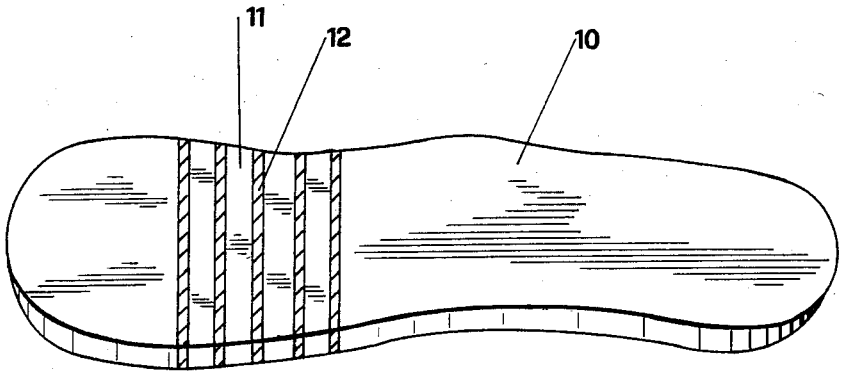

At this point a longitudinal cut is performed on the block 1, along the hatched lines 8 and 9, to a sufficient depth so as to cut intermediate wood between the channels 5 and 6, at the same time eliminating the two extremities 3 and 4 of the block 1, in such a manner as to obtain two perfectly symmetrical and opposite insoles, similar to the insole 10 (FIG. 6).

The insoles thus obtained, as well as being in perfectly symmetrical pairs adapted to be engaged onto two sandals worn by the same person, have a body of wood perfectly shaped in anatomical form on the upper surface to be contacted by the feet, and on the contrary flat underneath for contact with the body of the shoe, provided with a series of intermeidate strips 11 connected to each other by the layers of rubber 12 which keep the whole complex together but nevertheless giving to the insole sufficient flexibility adapted not to obstruct the articulation of the feet.

The advantages which are obtained with the process of the invention are obvious, because with each operation there is obtained a pair of perfectly symmetrical insoles provided moreover with a great elasticity above all in the longitudinal direction by reason of the strips of resilient rubber which connect the individual strips of the insole, likewise guaranteeing the same against slipping of the feet.

It is intended to include within the ambit of the patent also the case in which there is obtained by the operations described also a single insole each time from a single block, the lower surface of the same being left plane and the second insole of the pair being obtained by a second operation.

Naturally the constructive features of details of the process now described and illustrated in the accompanying set of drawings can have various shapes and aspects, keeping the essential characteristics of the invention without thereby exceeding the scope of the patent.

What is claimed is:

1. A process for producing a flexible anatomical insole of wood for footwear consisting of the steps of:

providing a block of wood of approximate parallelepipedal shape, shaping said block to obtain two opposed surfaces shaped in the approximate configuration of an insole, with two gripping projections extending from the ends thereof, cutting transverse channels on both of said surfaces, wherein said channels extend to approximately one-half the thickness of the block, introducing resilient rubber into said channels, cutting said block along a plane corresponding to one-half the thickness of the block, whereby two symmetrical insoles are obtained, each comprising transverse wooden strips connected to each other by strips of rubber.

* * * * *